United States Patent [19]

Saxlund

[11] 4,389,979

[45] Jun. 28, 1983

[54] METHOD AND APPARATUS FOR THE OPERATION OF A BOILER INSTALLATION WITH STOKER FIRING

[76] Inventor: Oddmund Saxlund, Heidberg 1, D-3040 Soltau-Harber, Fed. Rep. of Germany

[21] Appl. No.: 261,191

[22] PCT Filed: Sep. 3, 1980

[86] PCT No.: PCT/DE80/00127

§ 371 Date: May 1, 1981

§ 102(e) Date: May 1, 1981

[30] Foreign Application Priority Data

Sep. 3, 1979 [DE] Fed. Rep. of Germany ..... 2935494

[51] Int. Cl.[3] ..... F23G 7/00; F22B 5/00

[52] U.S. Cl. ..... 122/15; 110/244; 110/347; 110/348; 110/235; 432/99

[58] Field of Search ..... 432/99, 100; 110/103, 110/105.6, 347, 348, 270, 251, 243, 244, 225, 231; 122/15

[56] References Cited

U.S. PATENT DOCUMENTS

| | | | |
|---|---|---|---|
| 1,739,594 | 12/1929 | Jackson | 110/348 |
| 2,345,067 | 3/1944 | Isann | 432/99 |
| 2,597,585 | 5/1952 | Howard | 432/99 |
| 2,808,011 | 10/1957 | Miller et al. | 110/347 |
| 2,867,182 | 1/1959 | Crites | 110/347 |
| 2,956,527 | 10/1960 | Hopwood | 110/270 |
| 3,834,327 | 9/1974 | Hellstron et al. | 110/244 |
| 4,094,631 | 6/1978 | Grieve | 432/176 |
| 4,263,857 | 4/1981 | Ban | 110/348 |
| 4,291,634 | 9/1981 | Bergsten et al. | 110/238 |

FOREIGN PATENT DOCUMENTS

| | | |
|---|---|---|
| 720552 | 4/1942 | Fed. Rep. of Germany . |
| 2534841 | 6/1976 | Fed. Rep. of Germany . |
| 2266103 | 4/1965 | France . |
| 2319844 | 2/1977 | France . |

*Primary Examiner*—Henry C. Yuen

*Attorney, Agent, or Firm*—Lee, Smith & Jager

[57] ABSTRACT

A method and apparatus for the operation of a stoker-fired boiler having a boiler arranged coaxially adjacent to a stoker chamber. The cross-sectional area of the connection between the stoker and the boiler is constricted, preferably in the range of one-third to one-fourth of the cross-sectional area of the stoker chamber, so that the flammable gases flowing from the stoker to the boiler are accelerated and generate a reduced pressure at the constricted connection. Tertiary air is introduced at the circumference of the constricted connection at an increased pressure, to thereby induce more complete combustion of the gases. The area of flow flares out as the gas enters the boiler. In the preferred arrangement, guide means control the introduction of the tertiary air through an annular gap at the constricted connection The stoker also preferably includes rings of nozzles arranged at selected angles to introduce secondary air into the stoker chamber.

11 Claims, 2 Drawing Figures

Figure 1:
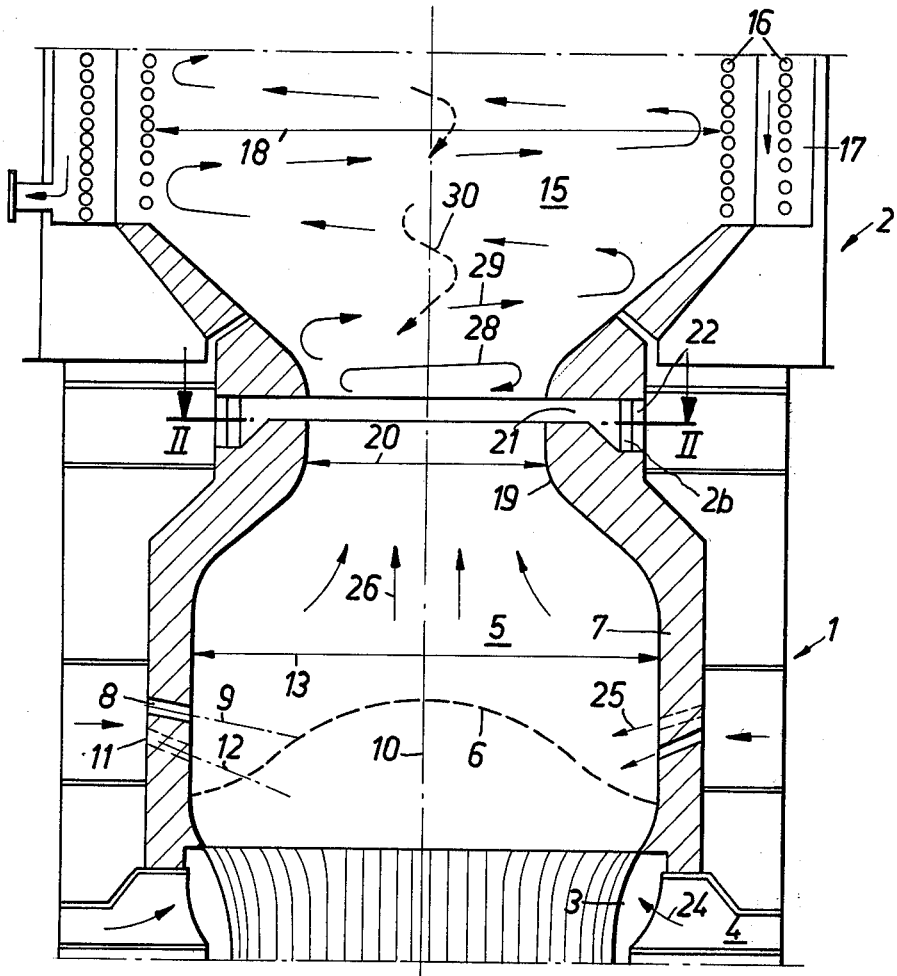

METHOD AND APPARATUS FOR THE OPERATION OF A BOILER INSTALLATION WITH STOKER FIRING

BACKGROUND AND GENERAL DESCRIPTION OF THE INVENTION

The invention relates to a method and an apparatus for the operation of a boiler installation with stoker-like firing, comprising a stoker chamber with a burner grating for the supply of the primary air, nozzles distributed over the periphery and a tubular boiler placed coaxially adjacent to the stoker chamber with an approximately circular inner chamber and annular gas aspiration.

Boiler installations with stoker-like firing are known in the prior art. In them the primary air is urged under pressure through the bars of the combustion grate which defines a bowl-shaped bottom for the fuel. The combustion takes place in two phases with a pre-combustion taking place in the bowl defined by the grating bars, while a post-combustion occurs, also called residual combustion, in the stoker chamber located above the bowl. The fuels burned in such installations develop, under a combustion of this kind, gases burnable on a large scale to which secondary air is admixed through nozzles placed in a crown-like arrangement, whereby the combustion in the stoker chamber takes place substantially free from residue.

It is known to design the firing equipment with a vertical axis and with an approximately circular cross-section, and to place the tubular boiler immediately above the stoker chamber which is open on top, so that the inner pipe crown practically forms a continuation of the stoker chamber. The inner chamber accommodating the pipe coils or pipe clusters is closed to a large extent at the top side, and the combustion gases are aspirated after having transferred their heat annularly to the pipe clusters, whereby it is possible to guide the gases several times annularly and, under reversal in axial direction, through pipe clusters surrounding each other concentrically.

In such boiler installations one considerable problem consists in that very high temperatures build up under optimal operation in the stoker chamber, so that the chamber walls are exposed to high thermal loads. It has been demonstrated in the art that a reduction of this thermal load, so that an optimal and economical operation is possible without too frequent shutdowns of the stoker firing system for a repair of the chamber walls, is extremely difficult. Therefore, the installations in most cases must be designed and built with higher expenses than what is necessary for actual operations under optimal conditions. This serious problem adversely affected the extended application of such boiler installations, although in principle they are extremely simple in their design and very economical in their operation, particularly since it became possible to provide for a reliable and satisfactory removal of the ashes without the necessity of a shutdown of the installation.

The invention is based on the problem of disclosing a method and an apparatus of the type defined initially in detail, with the aid of which it is possible to operate such a boiler installation with stoker firing under optimal conditions from a combustion-engineering point of view, without the need of frequent shutdowns for repairs at the chamber wall means. In this respect, care shall be taken primarily that with an improved manner of operation the installation can be built in a more space-saving manner and at a lower cost.

According to the invention this problem is solved by supplying the stoker chamber with primary air and secondary air sufficient only for a partial combustion of the fuel, by substantially constricting the cross-section of the flow of combustion gases and inflammable gases discharging from the stoker chamber, and by generating a pressure reduced with respect to the ambient pressure, whereby tertiary air is introduced tangentially at the circumference of the constricted flow at a pressure increased with regard to the ambient pressure and, subsequently, the cross-section of the entire flow again is flared upon its entry into the interior chamber.

As a result of the incomplete combustion in the grate bowl and in the stoker chamber, it is possible to maintain the temperature in the stoker chamber markedly lower than used before, so that the thermal load to which the chamber walls are exposed is substantially less. This makes it possible to construct the firing stoker with smaller dimensions and with less expense, whereby the lining materials of the stoker chamber have a substantially longer life than in the firing systems according to the prior art. The after-burning of the combustible gases produced in the stoker chamber takes place partly in the interior chamber of the tubular boiler. The air sufficient for this post combustion is supplied only at the area of connection between the stoker chamber and the interior chamber and, in fact, is supplied in a special manner. The feeding takes place under pressure and in a tangential direction in such a manner that a rotating air current results in the constriction or connection area between the stoker chamber and the boiler area, said rotation taking place along the inner wall means of the connection area. This current further constricts the gas flow and also converts it gradually into a current which rotates or ascends spirally and upwardly, and, based on the centrifugal forces behind the constriction, it has a tendency of ascending in close adherence at the pipe clusters forming the inner wall means of the interior chamber. This results in an adequate blending of air and gas mixture, so that the post combustion takes place preponderantly in the inner chamber. As a result of these described measures, such a strong subpressure is generated in the constriction area as compared with the ambient pressure existing at the same time that, in spite of the supply of tertiary air in this area, part of the gas located in the interior chamber of the boiler forms a core-like flow which reverses with spiral-like tendency at the ceiling of the boiler area and is oriented toward the point of constriction. This assures a complete post combustion of all flammable gases in the gas mixture, and assures an optimal thermal utilization of the gases. As a result of the return flow in the center of the combustion chamber, torn off unburned fuel particles carried along in the flow are returned to the fuel bed.

The extent of the constriction, the pressure, and the quantity of supplied tertiary air depend, among other factors, on the kind and composition of the fuel as well as on the extent of the incomplete combustion in the stoker chamber. It was found to be expedient to constrict the gas flow to about $\frac{1}{3}$ to $\frac{1}{4}$ of the cross-sectional area of the stoker chamber, and then to expand it to at least again approximately the cross-sectional area of the stoker chamber.

The invention is particularly appropriate with the installation arranged on a vertical axis, where the stoker chamber and the tubular boiler are immediately superposed and have an approximately circular cross-section.

For the practice of the method, the invention thus contemplates an apparatus where the stoker chamber is connected with the interior chamber of the boiler via a nozzle-like installation, and where in the connection area an installation is provided for the tangential supply of tertiary air. The nozzle-like constriction may be considered as a kind of Venturi nozzle. The mechanism for the supply of tertiary air appropriately is designed with an annular shape, and represents, at the same time, the most narrow point of the nozzle-like constriction. The super pressure at which the tertiary air is supplied is so adjusted that a rotating annular current develops at the narrowest location, which is so stable that it is not substantially destroyed by the gas mixture which ascends with increasing velocity. The rotational speed of this current will be adequate for expanding the total current after passage of the current through the most narrow point of the constriction in a spiral fashion, and in close contact with the pipe clusters in cross-section. The high gas velocity in the inner chamber of the boiler causes a better heat transfer coefficient between the combustion gases and the boiler wall.

The extent of the incomplete combustion in the stoker chamber can be controlled accurately by arranging the nozzles with a crown-like distribution over the circumferential wall of the stoker chamber, for the supply of secondary air opposite the stoker chamber axis, with a tilt which varies from the exterior to the interior and from the bottom down with respect to the axis of the installation. The differential slope may be in a range from about 10° to 40°. It preferably amounts to about 15° and 35°, and the nozzles of different slope are preferably alternated in circumferential direction. In that manner, the secondary air can be so distributed in the stoker chamber over the surface of the material to be burned that an accurate and uniform control of the combustion and gasification is possible in this area.

ILLUSTRATIVE EMBODIMENT

The invention shall be explained in greater detail below by means of the schematic drawings of one embodiment.

Figure 2:
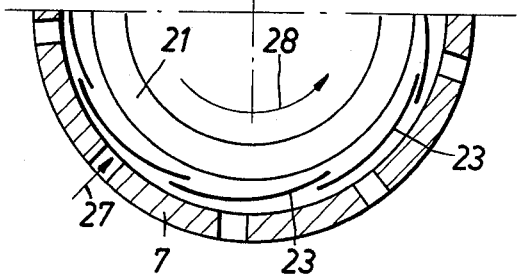

FIG. 1 shows in vertical section the central area of a boiler installation according to the invention comprising a stoker firing burner and a tubular boiler; and FIG. 2 shows a cross-section along the section line II—II of FIG. 1.

The boiler installation comprises the stoker firing burner 1 and the boiler 2. Both are vertically superimposed and arranged with respect to a common vertical axis 10, and are approximately circular in cross-section. The lower part of the stoker firing burner 1 is not shown in detail. However, the ring of grate bars 3 can be seen which belong to the lower bowl-like area of the stoker firing burner and into which the fuels 6 are introduced. Primary air is urged through corresponding air ducts 4, according to the arrows 24, through the grate bars and into the pile of combustion material 6. The stoker chamber 5, located above the grate bars, is lined in the usual manner with thermally chargeable materials 7. Nozzle crowns 8 and 11 are arranged in the wall of the lining, and consist of nozzle ducts distributed uniformly over the circumference and inclined from the exterior to the interior and from the top to the bottom toward the common axis 10 of the installation. Secondary air is blown in through these nozzle ducts under pressure according to the arrows 25 in the space above the surface of the fuel pile 6. In this case two kinds of secondary air nozzles 8 and 11 of differential slope 9 and/or 12 are contemplated. The nozzles 8 have the lesser slope 9, while the nozzles 11 have a greater slope 12 with respect to the axis 10 of the arrangement. In the case where the nozzles have two different slopes, they preferably are arranged in alternate circumferential directions. It also is possible to provide nozzle rings with three or four different slopes. The slopes range between about 10° and about 40°. In the exemplified embodiment they preferably amount to 15° for the nozzles 8, and to 35° for the nozzles 11. This nozzle angle relates to the angle that the associated nozzle radius defines when extended vertically to the axis 10.

The stoker chamber 5 preferably has a circular cross-section with a pre-determined diameter 13 commensurate with the performance of the installation.

The stoker firing burner 1 is followed on the same axis by the boiler installation 2, only the lower part of which is shown. The inner chamber of the boiler is surrounded, substantially over its entire height, by one or two concentric pipe coils 16, as in the exemplified embodiment. They may, as shown, be coiled tightly or have intersticial spaces. Instead of the pipe coils, it also is possible to provide pipe clusters arranged parallel and concentric with the axis 10; for example so-called fin pipes where the adjacent pipes arranged in spaced relation are interconnected by short partitions. The hot gases ascend in the boiler area 15, which to a large extent is sealed at its ceiling. The ascending current then is reversed into a downwardly oriented outer current which flows along annular chamber 17 of boiler area 15 at the outer pipe cluster. After having transferred their heat, the gases are aspirated annularly. It also is possible to provide more than two pipe clusters or concentric pipe rings. The overall diameter of the interior area 15 of the boiler, determined by the inner pipe cluster, is identified with the numeral 18.

The gases from the stoker chamber 5 can enter the inner chamber 15 freely. However, in the installation shown the connection area between the stoker chamber 5 and the inner chamber 15 is formed by a nozzle-like constriction 19. It is indicated schematically in FIG. 1, and is in general of a Venturi-like nature. The diameter at the narrowest point of the constriction 19 is identified by numeral 20.

As a result of the strong constriction, which only has $\frac{1}{3}$ to $\frac{1}{4}$ of the cross-sectional area of the stoker chamber, the gases ascending in the stoker chamber 5 are accelerated according to the arrows 26. The current slows down beyond the point of constriction 19 because of the considerable flaring that the inner chamber 15 forms above the constriction. The cross-sectional area of the inner chamber 15 preferably is equal to or greater than the cross-sectional area of the stoker chamber 5. In any event, the cross-sectional surface of the inner chamber 15 is substantially greater than the cross-sectional surface at the point of constriction 19. Based on this arrangement, a considerable subpressure forms in the ascending current of the gases in the area of the point of constriction. This subpressure causes part of the gases ascending as far as the ceiling of the inner chamber 15 to reverse the direction of flow, and to be aspirated back, as a kind of core current, into the area of the constriction and mixed in again into the ascending current of the gases exiting from the stoker chamber 5.

To maintain the thermal load of the lining 7 of the stoker chamber 5 low, the stoker firing burner is so operated by controlling the amount of the primary air 24 and of the secondary air 25 that, with the primary combustion occurring in the trough of the stoker burner and the post combustion occurring in the stoker chamber 5, only an incomplete combustion takes place. In such a stoker, the burning of the fuel 6 generates flammable gases on a large scale. Although this generation can be promoted by the described special design for the nozzle rings 8 and 11, the gas current ascending through the constriction 19 still contains, to a considerable extent, flammable gases which are not yet combusted. The additional air required for the complete combustion of these gases is introduced as tertiary air in the connection area between stoker chamber 5 and the inner chamber 15. This air is fed in from the exterior in the form of an air current rotating powerfully near the inner wall of the constriction 19, as demonstrated by the arrow 28 in FIG. 2. An annular chamber 21 with a wreath of guiding bodies 23 arranged tangentially in a spiral-like and circumferential direction, is provided for this purpose. The tertiary air is thereby supplied from an exterior air chamber, as demonstrated by arrow 27 in FIG. 2, via feed ducts 22 to the annular chamber 21 and appropriately discharges at the most narrow point of the constriction 19. The air is supplied at such a pressure that a powerful annular jet, surrounding the ascending gas jet, results. The rotating air current also puts the ascending gas current 26 in rotation, so that altogether an ascending spiral-shaped current 29 results which, because of centrifugal force, considerably flares after passing the constriction 19 by adhering closely to the inner walls of the inner chamber 15, which has a flared cross-section. By this arrangement, an intimate blending of air and gas mixture takes place, so that the further after-burning of the gases not yet burned starts at the narrowest point of the constriction 19. This after-burning continues far into the inner chamber 15. As a result of the considerable widening of the cross-section in the inner chamber 15, the flow speed considerably decreases in an upward direction, so that, within this spiral-shaped gas current, a spiral-shaped gas current 30 can develop in the opposite direction in the form of a central or core current directed from the ceiling of the inner chamber 15 toward the constriction 19. This returns part of the gases to the point of constriction. In this area, a blending of the reversed central or core current 30 and the ascending current 29 takes place.

In this manner, an optimal combustion of all flammable gases is obtained, with optimal utilization of the heat, while at the same time the temperatures at the walls of the stoker chamber 5 can be maintained below critical values. Hence, the thermal charge on the lining 7 of the stoker chamber remains within limits, and the life of the chamber becomes substantially higher. The entire installation thereby can be charged considerably higher at reduced dimensions, and can be utilized more optimally, thus allowing a more widespread application of this simple and economical installation.

Although the foregoing specification sets forth an illustrative embodiment of the invention, it will be appreciated by those skilled in the art that modifications and variations can be made without departing from the scope of the invention, as defined by the following claims.

What is claimed is:

1. A method for the operation of a boiler installation with stoker firing having a stoker chamber with a burner grating for supporting combustion material and for the passage of the primary air, introducing secondary air through nozzles distributed over the periphery, and a tubular boiler placed coaxially adjacent to the stoker chamber with an approximately circular inner chamber having pipe means associating therewith and annular gas extraction means, said method comprising the steps of:

supplying the stoker chamber with primary and secondary air sufficient only for a partial combustion of said combustion material and producing a mixture of combustion gases and unburned gases ascending in said stoker chamber;

substantially reducing the cross-section of the flow from said stoker chamber of said combustion gases and unburned gases to provide a nozzle-like constricted flow as said gases are discharging from the stoker chamber into the boiler chamber and to generate a pressure at said constricted flow reduced with respect to the ambient pressure;

introducing tertiary air sufficient for complete combustion tangentially at the narrowest point of the constricted flow at a pressure increased with regard to the ambient pressure;

rotating the flow of the combustion gases and unburned gases discharging from the stoker chamber and mixing said discharging gases with said tertiary air;

initiating after-burning of the unburned gases at the narrowest point of the constricted flow;

substantially increasing the cross-section of the entire flow again by flaring the rotating flow outwardly upon its entry into said boiler chamber;

directing the rotating flow upwardly toward the ceiling of the boiler chamber and transferring heat from combustion gases to said pipe means;

annularly extracting part of the upwardly flowing gases by means of said boiler extraction means;

redirecting part of the flow downwardly back toward the constriction from the ceiling of the boiler in a central core-type current flow to re-mix with the gases flowing upwardly from the constriction;

whereby complete combustion occurs in said boiler chamber and partial combustion occurs in said stoker chamber.

2. The method as defined in claim 1 wherein said constricted flow of said gas current is accomplished by reducing the cross-section of said flow to about $\frac{1}{3}$ to $\frac{1}{4}$ of the cross-sectional area of the stoker chamber and wherein said flow is subsequently expanded again to at least approximately the cross-section area of the stoker chamber.

3. A combustion apparatus comprising a stoker chamber with a burner grating for supporting combustion material and primary air ducts associated with the grating for the supply of fresh air, air supply nozzles distributed over the periphery of said stoker chamber for the supply of secondary air;

said primary air ducts and secondary air supply nozzles being controlled to provide less than sufficient air for complete combustion in the stoker chamber whereby during operation both combusted and uncombusted gases ascend in said stoker chamber;

a tubular boiler placed coaxially adjacent to the stoker chamber having an inner chamber with upper ceiling means, and annular gas extraction means;

means connecting the stoker chamber to the inner chamber of the boiler forming a nozzle-like constriction for receiving said ascending gases;

said tubular boiler flaring outwardly from said constriction; and a generally annular system to provide a tangential supply of pressurized tertiary air, sufficient for complete combustion, into said apparatus at the narrowest point of said nozzle-like constriction and being capable of placing ascending gases from said stoker chamber into rotation at said constriction and facilitate mixing with said tertiary air whereby after-burning of uncombusted gases initiates at said nozzle-like constriction and continues upwardly therefrom into said boiler inner chamber, and whereby said rotating gases flare outwardly and move upwardly from said constriction toward the ceiling means;

said annular system and boiler inner chamber being cooperative to facilitate flowing said rotating gases upwardly toward said ceiling means wherein a part of said upward flow is redirected at said ceiling means in a central downward core-type flow back toward said constriction to meet ascending gases from said stoker chamber and wherein part of said upwardly flowing gases is extracted at said extraction means;

pipe means associated with said boiler inner chamber capable of being heated by combusted gases; and, wherein complete burning of combustion gases is obtained in the boiler and part of the combustion occurs in the stoker chamber whereby said stoker chamber receives a reduced thermal charge permitting temperatures to be maintained below critical values.

4. The apparatus in accordance with claim 3 wherein the cross-sectional area at the narrowest point of the constriction is approximately $\frac{1}{3}$ to about $\frac{1}{4}$ of the cross-sectional area of the stoker chamber.

5. The apparatus in accordance with claim 4 wherein the cross-sectional area of the inner chamber of said boiler is approximately equal to the cross-sectional area of said stoker chamber.

6. The apparatus in accordance with claim 3 wherein the cross-sectional area of the inner chamber of said boiler is approximately equal to the cross-sectional area of said stoker chamber.

7. The apparatus in accordance with claim 3 wherein said air supply nozzles in said stoker chamber are arranged in a circumferential ring around a wall of the stoker chamber and provide a supply of secondary air to said stoker chamber and further wherein the radius of said nozzles slope with respect to the central axis of said stoker chamber by an angle in the range of between about 10° and 40°.

8. The apparatus in accordance with claim 7 wherein alternative nozzles in a circumferential direction vary in slope.

9. The apparatus in accordance with claim 3 wherein the tangential supply of tertiary air is provided by an annular gap having guiding means comprising a plurality of guide panels arranged in a spiral and partially overlapping configuration which form apertures in the annular gap pointing in a substantially circumferential direction.

10. The apparatus in accordance with claim 3 wherein the cross-sectional area of the inner chamber of said boiler is approximately equal to the cross-sectional area of said stoker chamber, and further wherein said air supply nozzles in said stoker chamber are arranged in a circumferential ring around a wall of the stoker chamber and provide a supply of secondary air to said stoker chamber and wherein the radius of said nozzles shape with respect to the central axis of said stoker chamber by an angle in the range of between about 10° and 40°.

11. The apparatus in accordance with claim 7 or 10 wherein said nozzles slope at an angle in the range of between 15° and 35°.

* * * * *